US006939041B2

(12) United States Patent
Kinigakis et al.

(10) Patent No.: US 6,939,041 B2
(45) **Date of Patent: *Sep. 6, 2005**

(54) FASTENER CLOSURE ARRANGEMENT FOR FLEXIBLE PACKAGES

(75) Inventors: Panagiotis Kinigakis, Buffalo Grove, IL (US); Kenneth Pokusa, Indian Head Park, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 154 days.

This patent is subject to a terminal disclaimer.

(21) Appl. No.: 10/353,436

(22) Filed: Jan. 29, 2003

(65) Prior Publication Data

US 2004/0146222 A1 Jul. 29, 2004

(51) Int. Cl.[7] ..... B65D 33/16

(52) U.S. Cl. ..... 383/61.2; 383/64; 383/203; 383/210

(58) Field of Search ..... 383/5, 61.2, 64, 383/203–204, 210–211; 493/213; 53/412

(56) References Cited

U.S. PATENT DOCUMENTS

| | | | |
|---|---|---|---|
| 2,994,469 | A | 8/1961 | Troup et al. |
| 3,181,583 | A | 5/1965 | Lingenfelter |
| 3,234,614 | A | 2/1966 | Plummer |
| 3,534,520 | A | 10/1970 | Moran |
| 3,579,747 | A | 5/1971 | Hawley |
| 3,660,875 | A | 5/1972 | Gutman |
| 3,790,992 | A | 2/1974 | Herz |
| 3,806,998 | A | 4/1974 | Laguerre |
| 3,819,106 | A | 6/1974 | Schuster |
| 4,186,786 | A | 2/1980 | Kirkpatrick |
| 4,262,395 | A | 4/1981 | Kosky |
| 4,355,494 | A | 10/1982 | Tilman |

(Continued)

FOREIGN PATENT DOCUMENTS

| | | | |
|---|---|---|---|
| EP | 0 443 867 | A1 | 8/1991 |
| JP | 61-259959 | | 11/1986 |
| JP | 01-226556 | | 9/1989 |
| JP | 04-173510 | | 6/1992 |
| JP | 4-215954 | | 8/1992 |
| JP | 5-91909 | | 4/1993 |
| JP | 5-91910 | | 4/1993 |
| JP | 7-112746 | | 5/1995 |
| JP | 7-187202 | | 7/1995 |
| JP | 9-216642 | | 8/1997 |
| JP | 10-706 | | 1/1998 |
| JP | 10-501714 | | 2/1998 |
| JP | 10-503672 | | 4/1998 |
| JP | 10-147352 | | 6/1998 |
| JP | 10203539 | A | 8/1998 |
| JP | 11-20051 | | 1/1999 |
| JP | 11157553 | A | 6/1999 |
| JP | 11314648 | | 11/1999 |

OTHER PUBLICATIONS

U.S. Appl. No. 09/836,984, filed Apr. 18, 2001.

(Continued)

* cited by examiner

*Primary Examiner*—Jes F. Pascua
(74) *Attorney, Agent, or Firm*—Fitch, Even, Tabin & Flannery

(57) ABSTRACT

A flexible package is provided with a shrouded slider fastener closure. The slider traverses fastener tracks which extend across the width of the flexible package, including side seals which form the side margins of the package. The film forming the front and real panels of the flexible package extends over and above the fastener tracks and slider, forming an upper shroud portion. A line of weakness is formed in the plastic film below the fastener tracks and a cut line immediately adjacent a side seal of the flexible package intersects the line of weakness so as to propagate a tear opening thereto. The cut line either extends to the side edge of the flexible package or an opening in the form of a tear notch, for example, is located in the side seal to initiate tearing with propagation to the cut line. In this manner, tension relief is provided for the plastic film while allowing the slider to remain substantially enclosed.

13 Claims, 3 Drawing Sheets

U.S. PATENT DOCUMENTS

| | | | |
|---|---|---|---|
| 4,516,268 | A | 5/1985 | Kamp |
| 4,534,158 | A | 8/1985 | McClosky |
| 4,586,319 | A | 5/1986 | Ausnit |
| 4,601,694 | A | 7/1986 | Ausnit |
| 4,617,785 | A | 10/1986 | Chikatani et al. |
| 4,646,511 | A | 3/1987 | Boeckmann et al. |
| 4,709,533 | A | 12/1987 | Ausnit |
| 4,729,709 | A | 3/1988 | Raasch |
| 4,745,731 | A | 5/1988 | Talbott et al. |
| 4,812,074 | A | 3/1989 | Ausnit et al. |
| 4,848,064 | A | 7/1989 | Lems et al. |
| 4,878,987 | A | 11/1989 | Van Erden |
| 4,894,975 | A | 1/1990 | Ausnit |
| 4,903,841 | A | 2/1990 | Ohsima et al. |
| 4,909,017 | A | 3/1990 | McMahon et al. |
| 4,927,271 | A | 5/1990 | Branson |
| 4,945,714 | A | 8/1990 | Bodolay et al. |
| 5,010,627 | A | 4/1991 | Herrington et al. |
| 5,014,498 | A | 5/1991 | McMahon |
| 5,014,499 | A | 5/1991 | Boeckmann |
| 5,020,194 | A | 6/1991 | Herrington et al. |
| 5,036,643 | A | 8/1991 | Bodolay |
| 5,067,208 | A | 11/1991 | Herrington, Jr. et al. |
| 5,080,747 | A | 1/1992 | Veix |
| 5,088,971 | A | 2/1992 | Herrington |
| 5,127,208 | A | 7/1992 | Custer et al. |
| 5,131,121 | A | 7/1992 | Herrington, Jr. et al. |
| 5,140,796 | A | 8/1992 | Pope |
| 5,141,795 | A | 8/1992 | Kai et al. |
| 5,161,286 | A | 11/1992 | Herrington, Jr. et al. |
| 5,167,107 | A | 12/1992 | Terminella et al. |
| 5,179,816 | A | 1/1993 | Wojnicki |
| 5,186,543 | A | 2/1993 | Cochran |
| 5,189,764 | A | 3/1993 | Herrington et al. |
| 5,211,482 | A | 5/1993 | Tilman |
| 5,238,306 | A | 8/1993 | Heintz et al. |
| 5,247,781 | A | 9/1993 | Runge |
| 5,283,932 | A | 2/1994 | Richardson et al. |
| 5,301,395 | A | 4/1994 | Richardson et al. |
| 5,322,579 | A | 6/1994 | Van Erden |
| 5,400,565 | A | 3/1995 | Terminella et al. |
| RE34,905 | E | 4/1995 | Ausnit |
| 5,405,478 | A | 4/1995 | Richardson et al. |
| 5,417,035 | A | 5/1995 | English |
| 5,435,864 | A | 7/1995 | Machacek et al. |
| 5,442,837 | A | 8/1995 | Morgan |
| 5,448,807 | A | 9/1995 | Herrington, Jr. |
| 5,482,375 | A | 1/1996 | Richardson et al. |
| 5,492,411 | A | 2/1996 | May |
| 5,505,037 | A | 4/1996 | Terminella et al. |
| 5,519,982 | A | 5/1996 | Herber et al. |
| 5,525,363 | A | 6/1996 | Herber et al. |
| 5,561,966 | A | 10/1996 | English |
| 5,564,259 | A | 10/1996 | Stolmeier |
| 5,664,299 | A | 9/1997 | Porchia et al. |
| 5,664,406 | A | 9/1997 | Smith |
| 5,669,715 | A | 9/1997 | Dobreski et al. |
| 5,681,115 | A | 10/1997 | Diederich et al. |
| 5,682,730 | A | 11/1997 | Dobreski |
| 5,687,549 | A | 11/1997 | Jostler et al. |
| 5,713,669 | A | 2/1998 | Thomas et al. |
| 5,722,128 | A | 3/1998 | Toney et al. |
| 5,725,312 | A | 3/1998 | May |
| 5,743,070 | A | 4/1998 | Lerner et al. |
| 5,746,043 | A | 5/1998 | Terminella et al. |
| 5,768,852 | A | 6/1998 | Terminella et al. |
| 5,769,772 | A | 6/1998 | Wiley |
| 5,775,812 | A | 7/1998 | St. Phillips et al. |
| 5,776,045 | A | 7/1998 | Bodolay et al. |
| 5,782,733 | A | 7/1998 | Yeager |
| 5,788,378 | A | 8/1998 | Thomas |
| 5,823,933 | A | 10/1998 | Yeager |
| 5,826,401 | A | 10/1998 | Bois |
| 5,833,791 | A | 11/1998 | Bryniarski et al. |
| 5,836,056 | A | 11/1998 | Porchia et al. |
| 5,845,465 | A | 12/1998 | Bennett |
| 5,845,466 | A | 12/1998 | Laudenberg |
| 5,867,875 | A | 2/1999 | Beck et al. |
| 5,871,281 | A | 2/1999 | Stolmeier et al. |
| 5,878,549 | A | 3/1999 | Littmann et al. |
| 5,884,452 | A | 3/1999 | Bois |
| 5,896,627 | A | 4/1999 | Cappel et al. |
| 5,902,047 | A | 5/1999 | Yeager |
| 5,904,425 | A | 5/1999 | May |
| 5,906,438 | A | 5/1999 | Laudenberg |
| 5,924,173 | A | 7/1999 | Dobreski et al. |
| 5,930,983 | A | 8/1999 | Terminella et al. |
| 5,937,615 | A | 8/1999 | Forman |
| 5,938,337 | A | 8/1999 | Provan et al. |
| 5,944,425 | A | 8/1999 | Forman |
| 5,947,603 | A | 9/1999 | Tilman |
| 5,950,285 | A | 9/1999 | Porchia et al. |
| 5,956,815 | A | 9/1999 | O'Connor et al. |
| 5,956,924 | A | 9/1999 | Thieman |
| 5,964,532 | A | 10/1999 | St. Phillips et al. |
| 5,983,594 | A | 11/1999 | Forman |
| 5,985,384 | A | 11/1999 | Shibata |
| 5,996,187 | A | 12/1999 | Tanaka et al. |
| 6,000,197 | A | 12/1999 | Ausnit |
| 6,019,512 | A | 2/2000 | Yeager |
| 6,029,428 | A | 2/2000 | Terminella et al. |
| 6,036,364 | A | 3/2000 | Heuvel |
| 6,044,621 | A | 4/2000 | Malin et al. |
| 6,047,450 | A | 4/2000 | Machacek et al. |
| 6,047,521 | A | 4/2000 | Terminella et al. |
| 6,071,011 | A | 6/2000 | Thomas et al. |
| 6,088,887 | A | 7/2000 | Bois |
| 6,131,369 | A | 10/2000 | Ausnit |
| 6,131,370 | A | 10/2000 | Ausnit |
| 6,138,436 | A | 10/2000 | Malin et al. |
| 6,138,439 | A | 10/2000 | McMahon et al. |
| 6,139,662 | A | 10/2000 | Forman |
| 6,148,588 | A | 11/2000 | Thomas et al. |
| 6,149,302 | A | 11/2000 | Taheri |
| 6,161,271 | A | 12/2000 | Schreiter |
| 6,177,172 | B1 | 1/2001 | Yeager |
| 6,178,722 | B1 | 1/2001 | McMahon |
| 6,183,134 | B1 | 2/2001 | Malin |
| 6,185,907 | B1 | 2/2001 | Malin et al. |
| 6,186,663 | B1 | 2/2001 | Ausnit |
| 6,199,351 | B1 | 3/2001 | Mount |
| 6,209,287 | B1 | 4/2001 | Thieman |
| 6,212,857 | B1 | 4/2001 | Van Erden |
| 6,216,423 | B1 | 4/2001 | Thieman |
| 6,219,993 | B1 | 4/2001 | Linkiewicz |
| 6,220,754 | B1 | 4/2001 | Stiglic et al. |
| 6,224,262 | B1 | 5/2001 | Hogan et al. |
| 6,244,021 | B1 | 6/2001 | Ausnit et al. |
| 6,244,746 | B1 | 6/2001 | Tokita et al. |
| 6,257,763 | B1 | 7/2001 | Stolmeier et al. |
| 6,270,256 | B1 | 8/2001 | Todman |
| 6,273,607 | B1 | 8/2001 | Buchman |
| 6,286,189 | B1 | 9/2001 | Provan et al. |

6,287,000 B1 9/2001 Buchman
6,287,001 B1 9/2001 Buchman
6,290,390 B1 9/2001 Buchman
6,290,391 B1 9/2001 Buchman
6,290,393 B1 9/2001 Tomic
6,292,986 B1 9/2001 Provan et al.
6,293,896 B1 9/2001 Buchman
6,327,754 B1 12/2001 Belmont et al.
6,327,837 B1 12/2001 Van Erden
6,347,885 B1 2/2002 Takanaka
6,360,513 B1 3/2002 Strand et al.
6,363,692 B2 4/2002 Thieman
6,364,530 B1 4/2002 Buchman
6,376,035 B1 4/2002 Dobreski et al.
6,378,177 B1 4/2002 Athans et al.
6,386,760 B1 5/2002 Tomic
6,389,780 B1 5/2002 Coomber et al.
6,412,254 B1 7/2002 Tilman et al.
6,427,421 B1 8/2002 Belmont et al.
6,438,926 B1 8/2002 Thieman
6,449,924 B2 9/2002 McMahon et al.
6,470,551 B1 10/2002 Provan et al.
6,474,045 B2 11/2002 McMahon et al.
6,477,821 B1 11/2002 Bois
6,481,183 B1 11/2002 Schmidt
6,499,272 B2 12/2002 Thieman
6,609,828 B2 * 8/2003 Schneider et al. ..... 383/204
6,616,333 B2 * 9/2003 Kinigakis et al. ..... 383/64
6,688,080 B2 * 2/2004 Kinigakis et al. ..... 53/412
2001/0001164 A1 5/2001 Van Erden
2001/0010253 A1 8/2001 Forman
2001/0017950 A1 8/2001 Strand et al.
2001/0039235 A1 11/2001 Buchman
2001/0039783 A1 11/2001 McMahon et al.
2001/0042357 A1 11/2001 McMahon et al.
2001/0045083 A1 11/2001 McMahon et al.
2001/0053253 A1 12/2001 Buchanan et al.
2002/0017078 A1 2/2002 Thieman
2002/0064320 A1 5/2002 May et al.
2002/0064321 A1 5/2002 Schrieter
2002/0064322 A1 5/2002 May
2002/0068668 A1 6/2002 Chow et al.
2002/0076122 A1 6/2002 Buchanan
2002/0090489 A1 7/2002 Dobreski et al.
2002/0118896 A1 8/2002 Forman
2002/0134046 A1 9/2002 Bois
2002/0134050 A1 9/2002 Thieman
2002/0150313 A1 10/2002 Bois
2002/0152719 A1 10/2002 Kinigakis et al.
2002/0152720 A1 10/2002 Kinigakis et al.
2002/0173414 A1 11/2002 Leighton
2002/0178556 A1 12/2002 McMahon et al.
2002/0184858 A1 12/2002 Ausnit et al.
2002/0194818 A1 12/2002 Thieman

OTHER PUBLICATIONS

U.S. Appl. No. 09/837,694, filed Apr. 18, 2001.
U.S. Appl. No. 09/945,537, filed Aug. 30, 2001.
U.S. Appl. No. 09/945,557, filed Aug. 30, 2001.
U.S. Appl. No. 09/994,105, filed Nov. 26, 2001.
U.S. Appl. No. 09/994,111, filed Nov. 26, 2001.
U.S. Appl. No. 09/994,255, filed Nov. 26, 2001.
U.S. Appl. No. 10/099,741, filed Mar. 15, 2002.
U.S. Appl. No. 10/155,401, filed May 23, 2002.
U.S. Appl. No. 10/174,614, filed Jun. 19, 2002.
U.S. Appl. No. 10/251,639, filed Sep. 20, 2002.
U.S. Appl. No. 10/280,335, filed Oct. 25, 2002.
U.S. Appl. No. 10/363,436, filed Jan. 29, 2003.
Exhibit A shows drawings of a package used by the Assignee of the present invention, which is admittedly prior art with respect to the above captioned patent application. Exhibit A includes three figures describing a package which is prior art with respect to the above–captioned patent application.
"Hefty's Plastic Zipper Bag Is Rapping Rivals", by Dean Starkman, article in *The Wall Street Journal*, date unknown.
International Search Report for EP 02 25 2742 of Jul. 9, 2002.

FASTENER CLOSURE ARRANGEMENT FOR FLEXIBLE PACKAGES

BACKGROUND OF THE INVENTION

1. Field of the Invention

The present invention pertains to the closure of flexible packages, such as plastic bags, and in particular to fastener closures employing sliders.

2. Description of the Related Art

With the ongoing emphasis in providing consumers with bulk quantities of various commodities, such as food products, reclosable packages have become increasingly popular. One of the most popular means of providing reclosability is to employ zippers of various types, particularly zippers which are compatible with flexible packages of plastic film construction. Manufacturers of food products and other commodities are concerned with filling the contents of a flexible package as quickly and economically as possible. It is important that the opening provided by the fastener be made as large as practically possible. Consumers or other end users also prefer large sized openings for easy extraction of products from the package interior. Even with large openings, however, products within the package may interfere with fastener operation when product poured or otherwise dispensed from the package becomes entrained in the fastener components.

Although improvements have been made in the art of making plastic bags, improvements are continually being sought. For example, bags having slide fasteners are employed in a wide variety of consumer products. When bags of this type are employed for sensitive consumer products, such as food products it is desirable to protect the opening of the bag from dust and other material associated with casual contact of the bag, during shipment and handling. It has been found convenient to employ sliders which traverse the interlocking fasteners, assuring complete interengagement of the fastener tracks with a minimum of manual dexterity. Sliders of increased width are popular, especially with young children and elderly consumers. In providing an over-covering for the slider it has been convenient to extend film comprising the side walls of the bag upwardly over the slider to form a shroud. Although economical, this technique causes tension in the plastic film due to the tight capture of the relatively massive slider between the sheets of plastic film. Holes have been formed in the shroud to serve as a tension relief for sliders which protrude partially or entirely through the hole.

SUMMARY OF THE INVENTION

It is an object of the present invention to provide a shrouded flexible package with an improved fastener closure.

Another object of the present invention is to provide reclosable packages having fastener sliders which are protected during shipment and display, and afterwards, when the package contents are poured out or otherwise extracted.

Yet another object of the present invention is to provide a shrouded reclosable plastic package having a slider fastener with improved containment of the slider.

A further object of the present invention is to provide a shrouded plastic bag having a slider fastener with an improved end or "crush" seal of the fastener tracks.

These and other objects of the present invention are attained in a reclosable flexible-package that comprises an opposed front and rear panels which have sides joined together to form an interior and a package opening communicating with its interior. A shroud covers slider and the major portion of fastener tracks, the shroud extends from the front and rear panels above the package opening. A weakening line joining the bottom end of the shroud to the front and the rear panels the weakening line extends along fastener tracks to sever the shroud in preparation for removal of the shroud from the remainder of the reclosable flexible package. The first and second interlockable fastener tracks configurable in an interlocked, closed position and an unlocked open position. A slider movable along fastener tracks to configure tracks in interlocked position so as to close opening and to configure fastener tracks in an unlocked position so as to allow access through the opening to the package interior. Fastener tracks having opposed ends located adjacent opposed sides of front and rear panels. End stops adjacent ends of fastener tracks to interfere with and prevent travel of the slider beyond the fastener tracks and cut lines in front and rear panels extending across fastener tracks to weakening line from a point above fastener tracks and immediately adjacent a side of front and rear panels so as to transmit a tearing force to weakening line while relieving tension in portions of front and rear panels overlying slider.

DETAILED DESCRIPTION OF THE PREFERRED EMBODIMENTS

Figure 1:
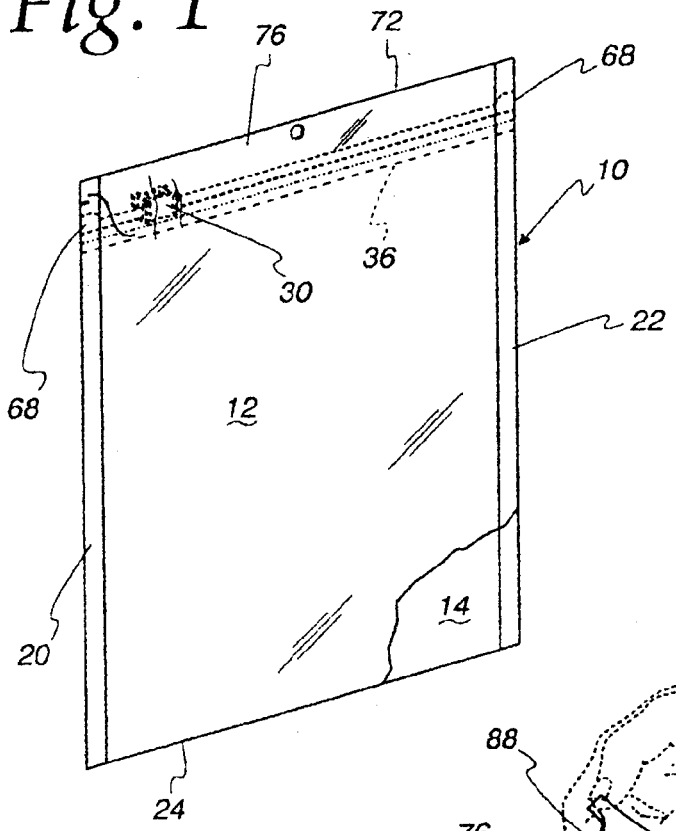
FIG. 1 is a perspective view of a flexible package according to principles of the present invention.
Figure 2:
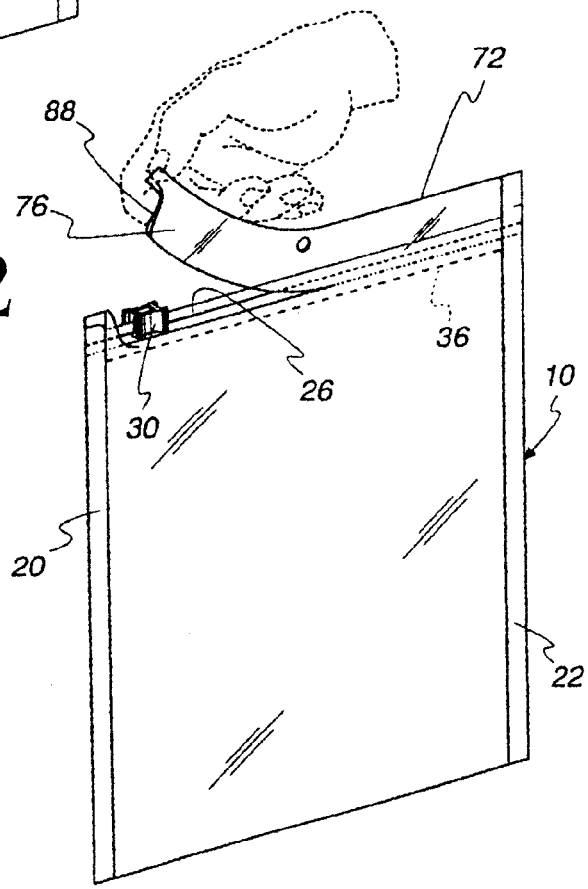
FIG. 2 is a perspective view showing the package of FIG. 1 being opened.
Figure 4:
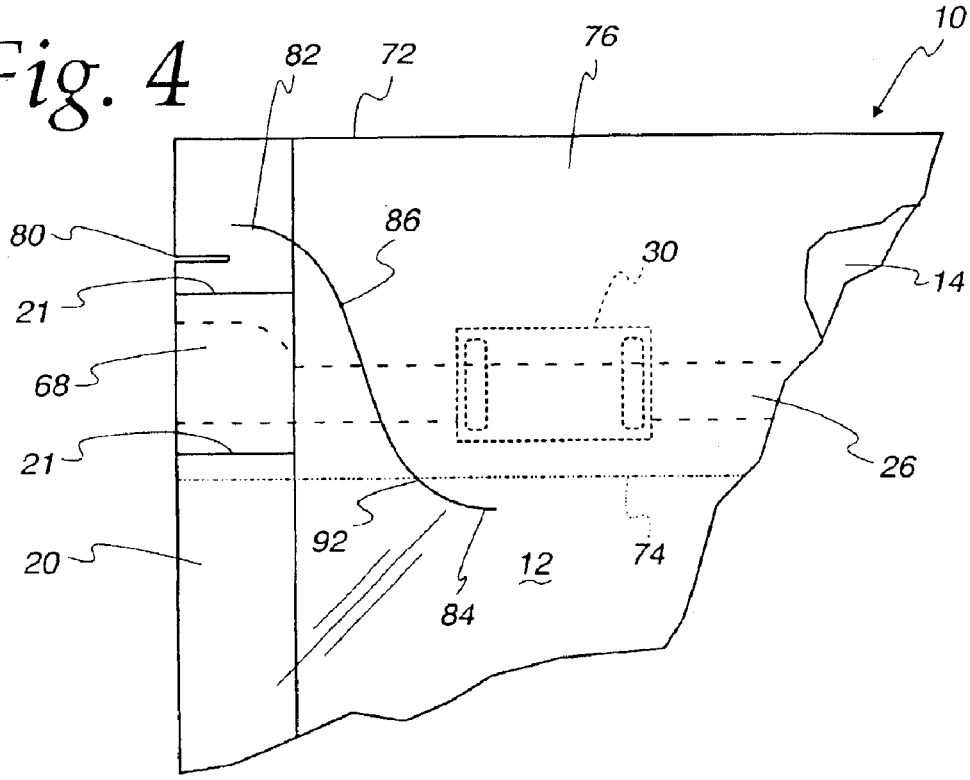

Referring now to the drawings and initially to FIGS. 1, 2 and 4, a flexible package illustrating principles of the present invention is generally indicated at 10. Flexible package 10 preferably comprises a plastic bag having front and back panels. 12, 14 joined together at the left end by a side seal 20 and at the right end by a side seal 22. Side seals 20, 22 are preferably of conventional conduction heat-sealed construction, having a generally constant width throughout. Panels 12, 14 are further joined together at their bottom ends either by a dead fold 24 or by a bottom seal extending between side seals 20, 22, as is known in the art. Preferably, the bottom seal is made by a fold line with panels 12, 14 being formed from a continuous sheet of plastic material.

The upper end of flexible package 10 features a reclosable opening including a slide fastener arrangement with fastener tracks 26 and a slider 30, all preferably of polyolefin material. The slider 30 is slidable along the fastener tracks, causing the fastener tracks to interlock or mate for closure of the flexible package and to unmate or separate to open the flexible package for access to contents in the package interior.

The flexible package according to principles of the present invention has found immediate commercial acceptance for use with food products, including perishable food products, such as cheese. Accordingly, it is generally preferred that the flexible package includes a hermetic seal 36 in the form of a peelable seal as taught in commonly assigned U.S. Pat. Nos. 5,014,856; 5,107,658; and 5,050,736, the disclosures of which are incorporated by reference as if fully set forth herein.

As mentioned above, flexible package 10 preferably comprises a bag having panels 12, 14 formed from plastic sheet material. The sheet material can be of a single material type, such as polyolefin materials including polyethylene and polypropylene, but preferably comprises a laminate assembly of several different material types, as is known in the art to provide a barrier to moisture as well as certain gases, such as oxygen or inert fillers of the types used with food products. Other types of laminate films, such as those known in the art to preserve food freshness, may be employed. Where the contents of the flexible package are not perishable or where other considerations may dictate, the panels 12, 14 can be constructed without regard to gas or vapor barrier properties. It is generally preferred that the fastener tracks be joined to web-like flanges which, in turn, are joined to panels 12, 14 as described in U.S. Pat. No. 6,357,914, the disclosure of which is incorporated herewith as if fully set forth herein.

Referring now to FIG. 2, fastener slider 30 has a top wall, and side walls. When the slider 30 of FIG. 1 is moved to the right, the fastener tracks 26, 28 are unlocked, thus opening the flexible package 10. Conversely, as slider 30 of FIG. 1 is moved to the left, fastener tracks 26, are interlocked to close the flexible package. The ends of the fastener tracks are deformed or "crushed" to form stops 68 (see FIG. 1). Preferably, stops 68 are formed by the application of ultrasonically generated heat and pressure to the ends of fastener tracks 26.

Referring now to FIG. 4, the plastic film comprising outer walls 12, 14 extends to the upper end 72 of package 10. Upper end 72 may be formed either as a welded seal or by a dead fold. A line of weakness 74 is formed in walls 12, 14 dividing the major portions of the wall from sub-portions referred to as shroud walls 76 which cooperate to form a shroud enclosing slider 30 and fastener tracks 26. The line of weakness 74 may be formed by any conventional means known today to facilitate tearing of the shroud portion 76 from the remainder of the side walls. Preferably, however, line of weakness 74 is formed by laser scoring techniques, as is known in the art.

Figure 3:
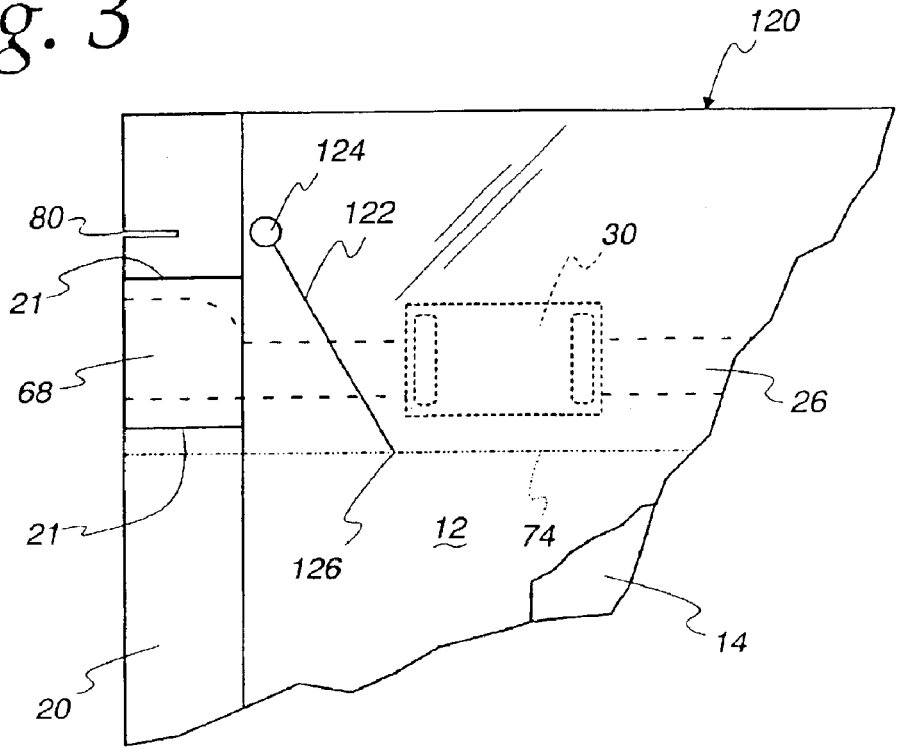
FIGS. 3–6 shows alternative embodiments according to various principles of the present invention.
Figure 5:
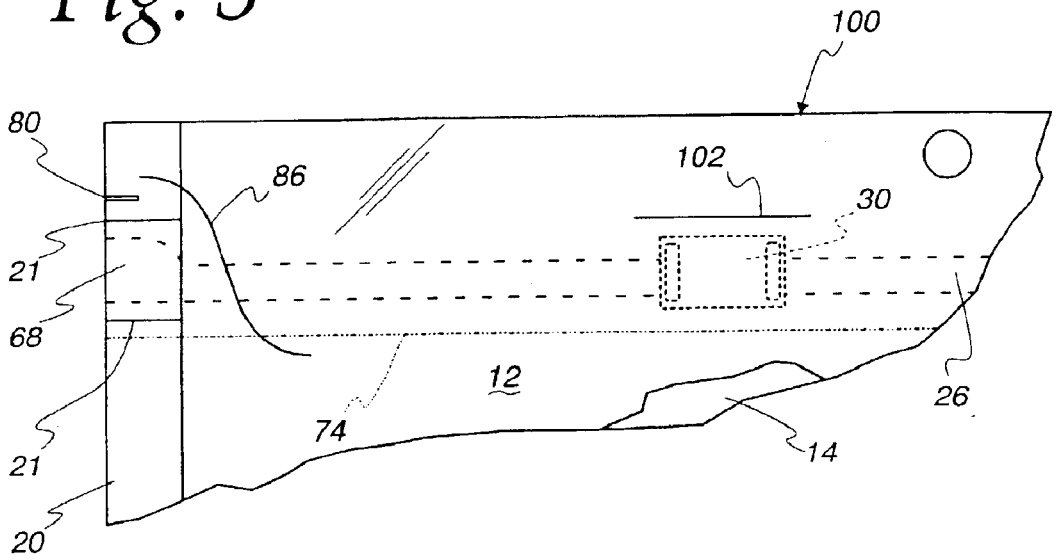
Figure 6:
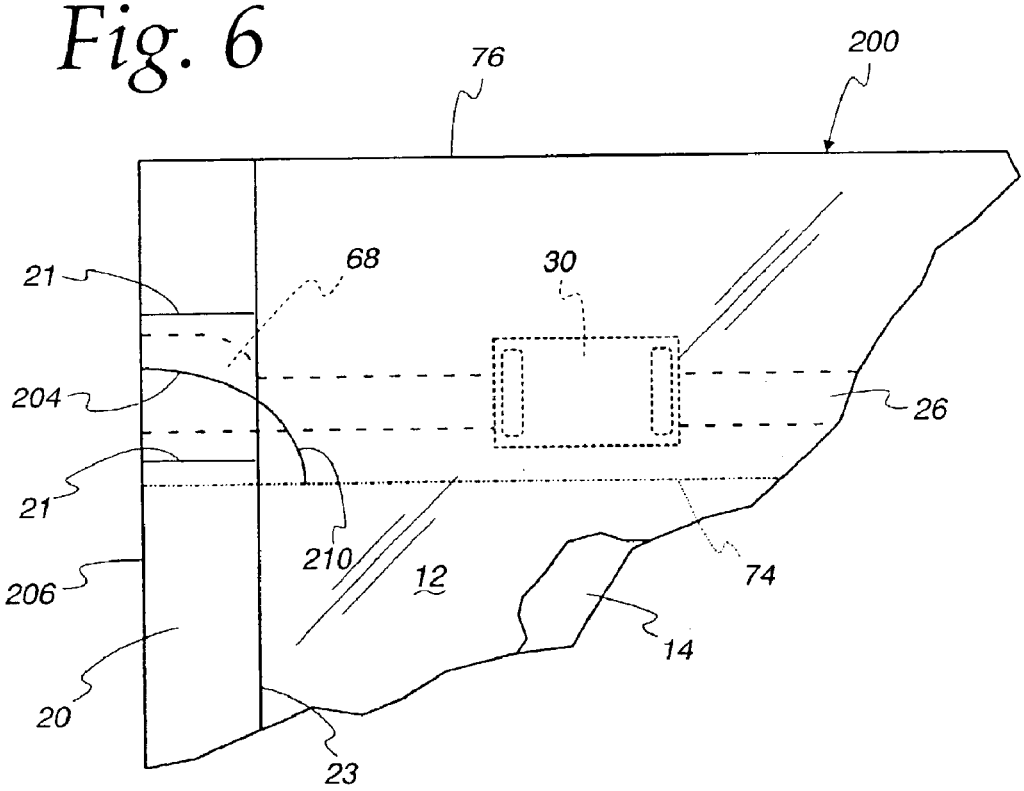

Referring again to FIG. 4, an opening 80 is formed in that portion of side seal 20 extending above fastener tracks 26, in the region of shroud portion 76. As illustrated, opening 80 comprises a straight notch, but could also comprise a V-shaped notch or a simple cut line. As can be seen in FIG. 4, opening 80 is spaced above stop 68 so as to avoid interference with the desired operation of the stop. In a preferred embodiment, side seal 20 is formed by welding sheets 12, 14 to form a fin seal. In the preferred embodiment, a gap is formed in side seal 20, as indicated by lines 21, to avoid disturbing end stop 68. This gap is also shown in FIGS. 3, 5 and 6.

Opening 80 extends inwardly from an outer edge of side seal 20 by an amount sufficient to assure the tearing will propagate successfully through the entire side seal, upon opening. In order to assure successful opening of the package, tearing is propagated to line of weakness 74, to allow removal of the shroud portion 76, in the manner shown in FIG. 2, accordingly, there is provided a curved cut line 86 which has a first end 82 adjacent opening 80 and a second end 84 extending below line of weakness 74. The cut line 86 can take on virtually any shape desired, but in the preferred embodiment it has a reverse S-shape. End portion 82 of cut line 86 is located immediately adjacent the inner end of opening 80.

In a preferred embodiment, end portion 82 is located immediately above opening 80 and intersects a line horizontally extending from opening 80 at a point interior of side seal 20. The relative orientation of end portion 82 and the alignment of the cut line with respect to opening 80 is arranged to assure that tearing initiated at opening 80 will reliably intersect cut line 86 and relative arrangement of the cut line with respect to the opening can vary from the preferred arrangement illustrated in FIG. 4.

Referring again to FIG. 4, it can be seen that cut line 86 extends across fastener tracks 26 and terminates at a point below line of weakness 74. Cut line 86 is preferably a full cut line and is located to one side of slider 30 so as to relieve tension in the film portions and shrouding slider 30. In operation, a film portion to the right side of cut line 86 in FIG. 4 is slightly outwardly expanded with respect to the film portions to the left of cut line 86. The opening formed by the outward expansion is minimal, and as can be seen in FIG. 4 slider 30 remains substantially, entirely enclosed despite the pressure relief offered by cut line 86.

Referring again to FIG. 4, the lower end portion 84 of cut line 86 extends slightly below line of weakness 74, so as to ensure intersection with line of weakness 74 despite production tolerances which might shift the relative orientation of the cut line with respect to line of weakness 74.

In operation, the user initiates tearing along opening 80 with the tearing vibrating to the right, through the entire extent of side seal 20. With continuing opening force, tearing migrates to intersect with the upper portion of cut line 86, adjacent end portion 82. Due to the full cut of cut line 86 no opening effort is needed to separate the free edge 88 of shroud 76 (see FIG. 2). Opening resistance is encountered at the point of intersection 92 of cut line 86 to line of weakness 74. As can be seen in FIG. 4, an acute angle is formed between end portion 84 and line of weakness 74. Due to the point-wise intersection of the cut line 86 with line of weakness 74, pressure at point 92 is relatively high and tearing propagation is readily transferred along line of weakness 74 in a reliable manner. With continued opening effort, tearing is propagated along line of weakness 74 to separate shroud portion 76 from the remainder of bag 10, as illustrated in FIG. 2.

Turning now to FIG. 5, an alternative flexible bag arrangement is generally indicated at 100. Flexible package 100 is substantially identical to flexible package 10 except for the addition of a tension-relieving secondary cut line 102 formed in film layers 12, 14. Cut line 102 is spaced immediately above slider 30 and operates to relieve tension by allowing that portion of film 12, 14 below cut line 102 to outwardly expand a slight amount. In the arrangement shown in FIG. 5, slider 30 and hence cut line 102 are spaced a greater distance away from the S-shaped cut line 86. The spacing in FIG. 5 between slider 30 and cut line 86 is somewhat exaggerated and can be reduced, if desired. However, it is generally preferred that a minimal spacing between cut lines 86, 102 be provided to assure that, during an initially tearing operation, tearing migration is limited to the intended path from notch 80 to cut line 86 and in turn to line of weakness 74.

Referring now to FIG. 3, an alternative flexible package arrangement is generally indicated at 120. Flexible package 120 is substantially identical to flexible package 10, described above, except for cut line 122. In the arrangement illustrated in FIG. 3, cut line 122 takes on a generally straight-line shape and extends from an end opening 124 to an intersection point 126 with line of weakness 74. Preferably, end opening 124 is located laterally adjacent opening 80. End opening 124 assures a greater probability that the tear line migrating from opening 80 will direct tearing along line 122, as desired. The lower end of cut line 122 intersects line of weakness 74, an arrangement which has been found sufficient to transfer tearing from cut line 122 to line of weakness 74 in a desired, reliable manner. If desired, cut line 122 can extend below the line of weakness 74 and this may be desirable in instances where production tolerances are wide enough as to require the added length of the cut line. Similarly, the end opening 124 can be located either above or to the left of the position indicated in FIG. 3 to further add to the reliability of tearing propagation in the desired manner.

Turning now to FIG. 6, an alternative flexible package arrangement is generally indicated at 200. The arrangement is generally identical to that of FIG. 1 except for cut line 204. As shown in FIG. 6, cut line 204 extends from an outer edge 206 across side seal 20. With this construction, a separate tear notch is not required. As shown in FIG. 6, the lower end 210 of cut line 204 lies at or preferably, beyond the inner edge of side seal 20, and intersects or passes beyond the line of weakness 74. Cut line 204 comprises a full cut in sheets 12, 14 and overlies opposed sides of end stop 68. Preferably, the bottom end of cut line 204 is extended to the right of the inner edge 23 of side seal 20, so as to assure tearing is propagated along line of weakness 74 and is not interfered with by the welding that forms side seal 20. The bottom end of cut line is terminated either immediately adjacent to, or intersecting line of weakness 74. In the preferred embodiment, cut line 204 comprises a continuously curved line, most preferably in the general form of a quarter circle. If desired, cut lines of virtually any shape, including a straight line can be employed in the arrangement of FIG. 6. In operation, a user grasps the upper extent of films 12, 14 comprising shroud portion 76. Tearing force is immediately transferred to the point of intersection of cut line 204 and line of weakness 74 and tearing is propagated along line of weakness 74 in the desired manner, to achieve an opening similar to that shown in FIG. 2.

In the various arrangements described above, cut lines are formed at or immediately adjacent to a side seal of the flexible package. It is recognized that the flexible package may be formed from films having a wide range of stiffness, and rigidity. Further, some film types may, under tension, readily sever at a defined line of separation, or alternatively may stretch with an attendant reduction in film thickness. Stretchable films may exhibit characteristics which would prevent successful tear opening, absent the features of the present invention described above. In any event, it may be expected that cutting of the flexible package may weaken or destroy the structural integrity at the package comer. However, it should be born in mind that the present invention contemplates tears open features located at or near fastener tracks and end stops which extend into the package side seal, thus adding a substantial amount of rigidity and overall structural integrity to the package, despite cut lines, notches and other opening features according to principles of the present invention.

It is generally preferred that the cut lines described above are formed in the plastic film prior to assembly of the film with the fastener tracks, thus, preventing interference with structural integrity of the fastener tracks and end stops as may result from cutting over penetration applied to an overlying film.

As mentioned above, introduction of the various cut lines in the shroud compromises the integrity of the covering protection of the shroud about the slider member as well as portions of the fastener tracks traversed by the slider member. It is generally preferable that the opening arrangements according to principles of the present invention are applied to flexible packages which provide other arrangements for enclosing a perishable contents such as food product. In particular, it is generally preferred that the present invention is employed with flexible packages having a conventional peal seal which protects the package contents, despite openings formed in the shroud portion of the package. The peal seal may, however, be eliminated if desired.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A reclosable flexible package comprising:

opposed front and rear panels having sides and joined together to form an interior and a package opening communicating with said interior;

a shroud covering said slider and at least the major portion of said fastener tracks, said shroud extending from said front and said rear panels above the package opening;

a weakening line joining a bottom end of said shroud to said front and said rear panels, said weakening line extending along said fastener tracks for severing said shroud in preparation for removal of said shroud from the remainder of said reclosable flexible package;

first and second interlockable fastener tracks configurable in an interlocked, closed position and an unlocked open position;

a slider movable along said fastener tracks to configure said tracks in said interlocked position so as to close said opening and to configure said fastener tracks in said unlocked position so as to allow access through said opening to said package interior;

said fastener tracks having opposed ends located adjacent said opposed sides of said front and said rear panels;

end stops adjacent said ends of said fastener tracks to interfere with and prevent travel of said slider beyond said fastener tracks;

a side seal of pre-selected width joining together one side of said front and said rear panels;

an edge cut above said fastener tracks extending inwardly across at least portion of said side seal from a free edge at one side of said front and said rear panels; and cut lines in said front and said rear panels extending across said fastener tracks to said weakening line from a point above said fastener tracks and spaced from said edge cut and said free edge, so as to transmit a tearing force to said weakening line while relieving tension in portions of said front and rear panels overlying said slider.

2. The reclosable flexible package of claim 1 wherein said shroud continuously covers the substantial entirety of said fastener tracks and said slider.

3. The reclosable flexible package of claim 1 wherein the second end of said cut line intersects said weakening line.

4. The reclosable flexible package of claim 1 wherein said weakening line extends across substantially the entire extent of said reclosable flexible package.

5. The reclosable flexible package of claim 1 wherein said edge cut comprises a notch formed in one side of said reclosable flexible package immediately adjacent said cut line to initiate tearing of said reclosable flexible package.

6. The reclosable flexible package of claim 1 wherein the said cut line is a generally straight line.

7. The reclosable flexible package of claim 1 wherein said cut line includes a curved line portion.

8. The reclosable flexible package of claim 1 further comprising a peelable seal preventing communication of said opening with said package interior.

9. The reclosable flexible package of claim 8 wherein said peelable seal comprises a hermetic seal.

10. The reclosable flexible package of claim 1 wherein said stops comprise deformed end portions of said fastener track.

11. The reclosable flexible package of claim 1 wherein said edge cut extends across at least a substantial portion of said side seal and said cut lines have a generally reverse S-shape with the first end adjacent said edge cut and a second end adjacent said weakening line.

12. The reclosable flexible package of claim 11 wherein the second end of said cut lines form an acute angle with said weakening lines.

13. The reclosable flexible package of claim 11 wherein first said said end of said cut lines is above said end stop.

* * * * *

UNITED STATES PATENT AND TRADEMARK OFFICE

CERTIFICATE OF CORRECTION

PATENT NO. : 6,939,041 B2
DATED : September 6, 2005
INVENTOR(S) : Kinigakis et al.

It is certified that error appears in the above-identified patent and that said Letters Patent is hereby corrected as shown below:

Column 6,
Line 51, after “least”, insert -- a --.

Column 8,
Line 12, after “wherein”, insert -- the --; and after “first”, delete “said”.

Signed and Sealed this

Fourteenth Day of February, 2006

JON W. DUDAS
*Director of the United States Patent and Trademark Office*